United States Patent [19]

Chalmers

[11] Patent Number: 5,018,670

[45] Date of Patent: May 28, 1991

[54] CUTTING HEAD FOR WATER JET CUTTING MACHINE

[75] Inventor: Eric J. Chalmers, Minneapolis, Minn.

[73] Assignee: Possis Corporation, Minneapolis, Minn.

[21] Appl. No.: 463,251

[22] Filed: Jan. 10, 1990

[51] Int. Cl.[5] ..... B24C 5/04

[52] U.S. Cl. ..... 239/433; 239/600; 51/439; 83/177

[58] Field of Search ..... 239/433, 600, DIG. 8, 239/340; 83/53, 177, 941; 51/439

[56] References Cited

U.S. PATENT DOCUMENTS

| | | | |
|---|---|---|---|
| 2,176,577 | 10/1939 | Tirrell . | |
| 3,419,220 | 12/1968 | Goodwin et al. . | |
| 3,982,605 | 9/1976 | Sneckenberger . | |
| 3,994,097 | 11/1976 | Lamb . | |
| 4,149,345 | 4/1979 | Atsuchi . | |
| 4,218,855 | 8/1980 | Wemmer . | |
| 4,380,138 | 4/1983 | Hofer . | |
| 4,478,368 | 10/1984 | Yie | 239/600 |
| 4,545,157 | 10/1985 | Saurwein | 239/433 |
| 4,555,872 | 12/1985 | Yie . | |
| 4,587,772 | 5/1986 | Griffiths . | |
| 4,631,871 | 12/1986 | Saunders . | |
| 4,663,893 | 5/1987 | Savanick et al. . | |
| 4,666,083 | 5/1987 | Yie | 51/439 |
| 4,702,042 | 10/1987 | Herrington et al. . | |
| 4,707,952 | 11/1987 | Krasnoff . | |
| 4,711,056 | 12/1987 | Herrington et al. . | |
| 4,815,241 | 3/1989 | Woodson . | |
| 4,817,874 | 4/1989 | Jarzebowicz | 239/600 |
| 4,852,800 | 8/1989 | Murdock . | |
| 4,862,911 | 9/1989 | Yie . | |
| 4,934,111 | 6/1990 | Hashish et al. | 51/439 |

FOREIGN PATENT DOCUMENTS

| | | |
|---|---|---|
| 484524 | 7/1952 | Canada . |
| 494888 | 3/1930 | Fed. Rep. of Germany . |
| 1477991 | 7/1969 | Fed. Rep. of Germany . |
| 400811 | 4/1966 | France . |

*Primary Examiner*—Andres Kashnikow
*Assistant Examiner*—Karen B. Merritt
*Attorney, Agent, or Firm*—Burd, Bartz & Gutenkauf

[57] ABSTRACT

A cutting head for a water jet cutting machine has a body removably supporting a holder with an orifice element, and insert with a chamber, and a nozzle having a passage in alignment with the water flow path through the head. The holder has a cone shaped surface that fits into a complimentary shaped cone recess to align the aperture of the orifice element with the axis of a water inlet chamber. The insert is retained within a transverse bore in the body to align its chamber with the axis of the aperture. A griping collet holds the nozzle on the body and aligns the passage of the nozzle with the axis of the aperture so that aperture, insert chamber, and the passage of the nozzle are linearly aligned with each other to form the water flow path through the nozzle.

29 Claims, 4 Drawing Sheets

CUTTING HEAD FOR WATER JET CUTTING MACHINE

FIELD OF THE INVENTION

The invention relates to fluid jet cutting machines having cutting heads for producing a high velocity fluid jet for cutting a workpiece. More particularly the invention relates to a cutting head for producing a water jet which contains abrasive materials.

BACKGROUND OF INVENTION

It is known to employ a water jet bearing a suspension of abrasive materials for cutting workpieces. Fluid jet cutting machines have pumps known as intensifiers that increase the pressure of water in the range of 60,000 psi. The ultra high pressure water is forced through a jewel nozzle having a small orifice to generate a jet having a high velocity stream of water. To enhance the cutting power of the water jet, abrasive materials have been added to the jet stream. The abrasive materials are added to the water downstream from the orifice of the jewel nozzle into a mixing region wherein the abrasive material is entrained with the water jet. After passing through the mixing region, the abrasive jet exits from the mixing region through an elongated outlet nozzle which directs the jet toward the workpiece. It is known that to maximize the life of the mixing nozzle the internal fluid path should be generally concentric with the abrasive jet. The mixing nozzle wears out quickly and becomes inefficient as the material quickly erodes. Concentricity and alignment is difficult to attain. Imperfections in the jewel cause the path of the water jet to deviate. Installation of the jewel can cause further deviation of the water jet from the longitudinal axis of the mixing chamber and nozzle passage. Also, manufacturing tolerences in the parts of the cutting heads can create variations in the water jet path and the longitudinal axis of the path of the orifice, mixing chamber and nozzle passage. One attempt to mitigate this problem is to provide adjusting structures so that the fluid jet and abrasive jet can be made concentric with the internal fluid path of the abrasive nozzle. An example of an adjusting structure for the jewel and its orifice is disclosed by Jarzebowicz in the U.S. Pat. No. 4,817,874.

SUMMARY OF INVENTION

The invention is related to a cutting head for a fluid jet cutting machine. The cutting head has a longitudinal fluid flow axis, such as a water flow axis, concentric with an orifice in an orifice element and a passage in a nozzle that directs the jet toward a workpiece. The cutting head has a body with a longitudinal axis and a relatively large upstream water inlet chamber for receiving water under ultra high pressure. An orifice element having a relatively small orifice or hole is aligned with the axis and open to the chamber. The orifice element is mounted on a holder having an outlet passage axially aligned with the axis in communication with the orifice. The holder has a cone shaped surface which cooperates with a converging cone shaped recess in the body to axially align the orifice with a longitudinal axis of the body. The body has a transverse bore accommodating an insert having an abrasive mixing chamber aligned with the longitudinal axis. An elongated nozzle having a passage aligned with the longitudinal axis is mounted on the body below the insert. A collet grips the nozzle to hold the nozzle on the body.

The body has an upwardly directed cone shaped surface engagable with tapered surfaces of the collet to align the passage of the nozzle with the longitudinal axis of the body. The cone shaped surfaces of the body are precision machined so that they are concentric with each other relative to the longitudinal axis of the body. The nozzle is centered relative to its inner diameter to insure concentric alignment of the nozzle passage with the longitudinal axis. The orifice element and holder are replaced as a unit from the body. The cooperating cone shaped surfaces of the holder and body insure alignment of the orifice with the longitudinal axis of the body. When the nozzle is replaced the cone shaped surfaces of the collet and body concentrically locate the nozzle passage with the longitudinal axis. The alignment of the nozzle with the longitudinal axis results in even and centered wear of the internal passage of the nozzle thereby extending the use of the nozzle. The cutting head has a relatively short distance between the orifice and the entrance to the nozzle passage which keeps the water steam coherent and minimizes angular misalignment between the water stream and the nozzle passage. When the orifice element is replaced due to normal wear with a new orifice element the location of the abrasive stream and the alignment of the orifice is not changed. The body engages a pilot surface on a coupling which minimizes angular and parallel misalignment.

DESCRIPTION OF PREFERRED EMBODIMENT

Figure 1:
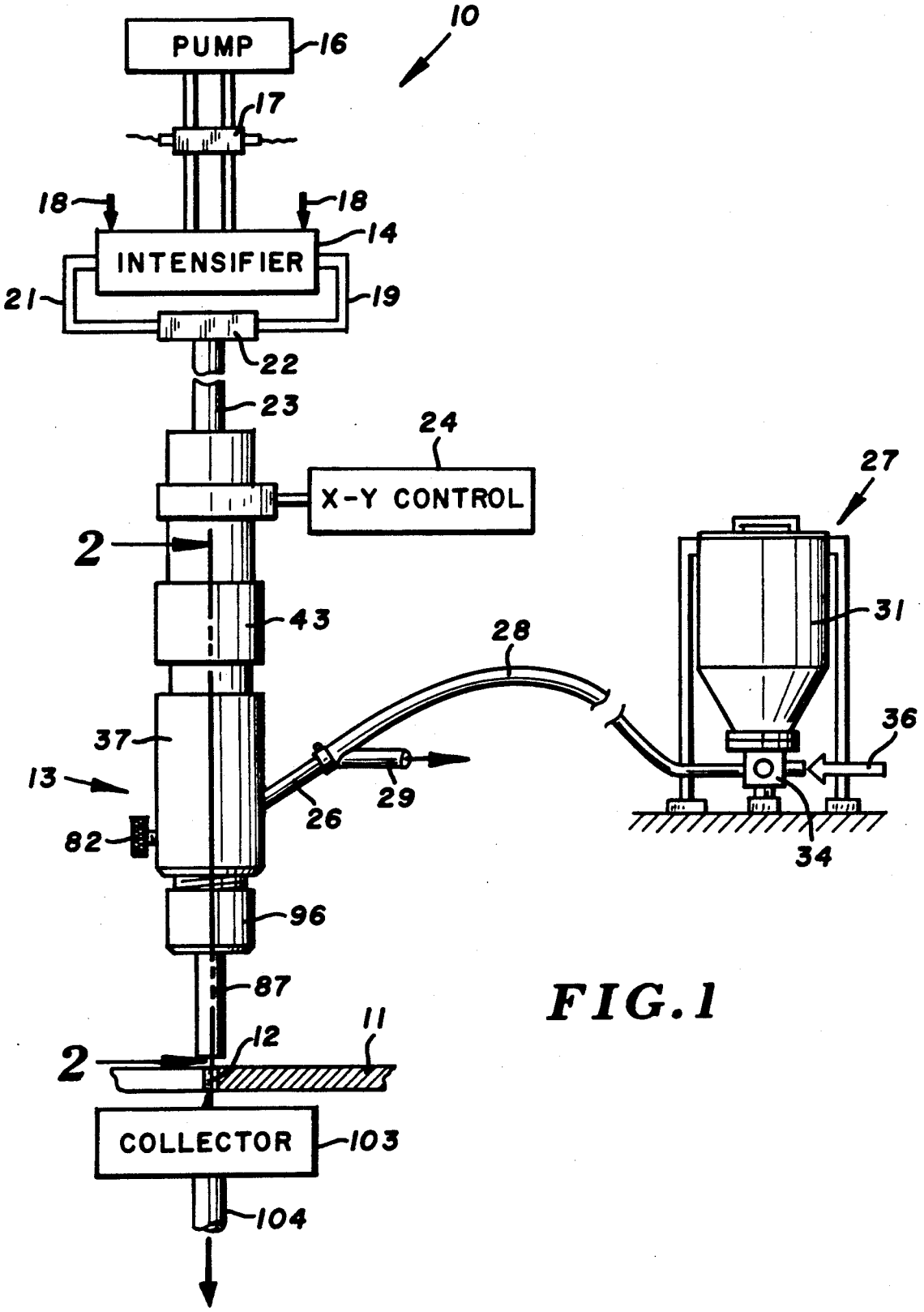
FIG. 1 is a diagramatic view of an abrasive water jet cutting system having the cutting head of the invention.

Referring to FIG. 1, there is shown a water jet cutting apparatus indicated generally at 10 for cutting a workpiece 11, such as metal, plastic, ceramic and like materials with an ultra high pressure abrasive carrying jet 12 eminating from a cutting head indicated generally at 13. Other types of liquids and mixture of liquids can be used in the jet cutting apparatus. Water under ultra high pressure, such as 25,000 psi or more is generated by an intensifier 14 and delivered to cutting head 13. A pump 16 supplies water under pressure via a reversing solenoid valve 17 to operate intensifier 14. A water supply 18 under nominal pressure is delivered to intensifier 14 which in turn increases the pressure of the water and discharges the water to lines or tubes 19 and 21 leading to an accumulator 22. A conduit pipe or hose 23 delivers water at ultra high pressure water, such as 60,000 or more psi, from accumulator 22 to the inlet of cutting head 13. An example of an intensifier for delivering a flow of ultra high pressure water is disclosed in U.S. Patent application Ser. No. 493,422, incorporated herein by reference.

Cutting head 13 is moved relative to workpiece 11 to cut designated parts from the workpiece. An X-Y control 24 connected to cutting head 13 moves head 13 in response to computer program controls that establishes the cutting path of jet 12.

Cutting head 13 has a lateral nipple 26 coupled to a hopper 27 accommodating abrasive material or grit with a elongated hose 28. Hose 28 fits over nipple 26 adjacent an overflow tube 29 which carries excess grit from nipple 26. Hopper 27 has a generally upright tank 31 located above an abrasive feed unit 34. An air supply 36 connected to feed unit 34 forces the grit to flow with the air through hose 28 to nipple 26 into cutting head 13. The grit is a crushed almandine garnet having uniform physical, chemical and micro structure characteristics. This material is a natural mineral that has minimum environmental effects.

Figure 2:
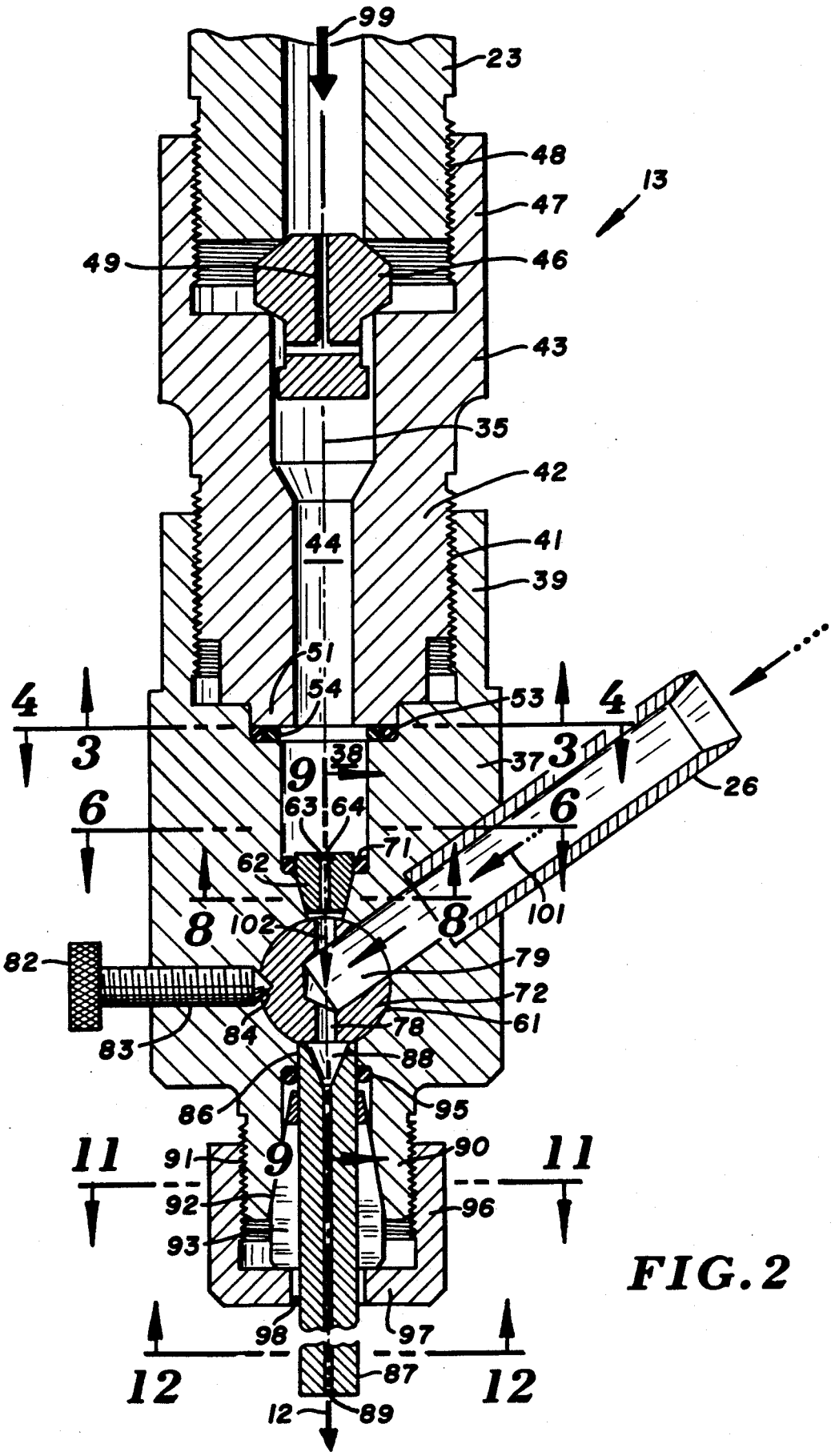
FIG. 2 is an enlarged foreshortened sectional view taken along the line 2—2 of FIG. 1.
Figure 3:
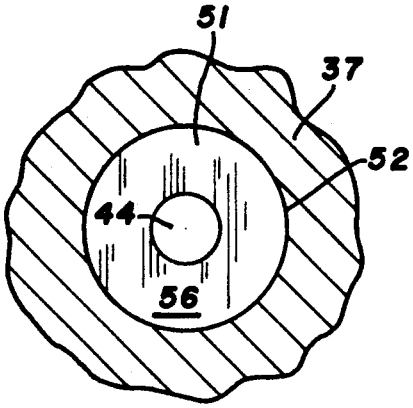
FIG. 3 is an enlarged sectional view taken along the line 3—3 of FIG. 2.

Referring to FIG. 2, cutting head 13 has a generally upright body 37 having a water inlet chamber 38. A sleeve or coupling 43 connects pipe 23 to body 37. An internal threaded sleeve 39 having threads 41 at the upper end of body 37 accommodates a male threaded end 42 of coupling 43. Coupling 43 has a passage 44 open to chamber 38 to deliver ultra high pressure water to chamber 38. The upper end of passage 44 accommodates a seal plug 46 located in sealing relation with the end of pipe 23. Pipe 23 is threaded into a tubular sleeve 47 on the upper end of coupling 43. Sleeve 47 has internal threads 48 accommodating the male threads of pipe 23. Plug 46 has a passage 49 leading from the passage of pipe 23 to coupling passage 44. As shown in FIGS. 2 and 3, the lower end of coupling 43 has a cylindrical boss 51 that fits into a cylindrical recess 52 in body 37. Boss 51 aligns passage 44 with the longitudinal axis 35 of chamber 38 to consistently align the abrasive water jet stream exit location. As shown in FIG. 2, axis 35 is also the longitudinal axis of body 37 and the axis of the water flow path through body 37 and nozzle 87 mounted on the body.

Figure 4:
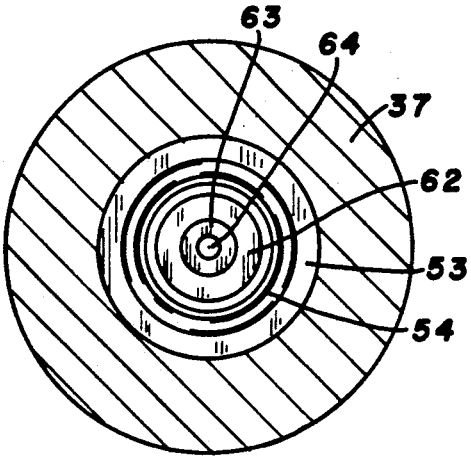
FIG. 4 is an enlarged sectional view taken along the line 4—4 of FIG. 2.
Figure 5:
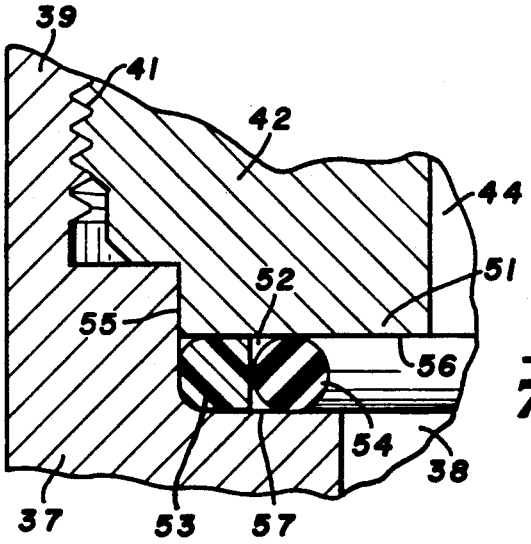
FIG. 5 is an enlarged sectional view of the seal between the coupling and body as shown in FIG. 4.

Referring to FIGS. 4 and 5, a face seal assembly comprising a pair of annular seals 53 and 54 is located in the bottom of recess 52 and engages the bottom of boss 51 to maintain seal integrity between body 37 and coupling 43. As shown in FIG. 5, the annular seals 53 and 54 are in compressed sealing engagement with the bottom 56 of boss 51 and the bottom 57 of recess 52 in body 37. Seal 54 is an O-ring located within seal 53. Seal 53 is an annular plastic member that functions as a compressed back up element for the O-ring. The face seal assembly requires lower sealing torque than static crush seals. The face seal assembly permits metal to metal contact between boss 51 and the cylindrical wall 55 surrounding recess 52 to assure consistent nozzle alignment. The cylindrical wall 55 is a pilot surface concentric with longitudinal axis 35 to preserve longitudinal alignment of body 37 with coupling 43. Body 37 can be removed from coupling 43 and replaced without recalibrating the longitudinal alignment of the body relative to the coupling. This ensures consistent water exit stream location relative to the water motion system.

Figure 6:
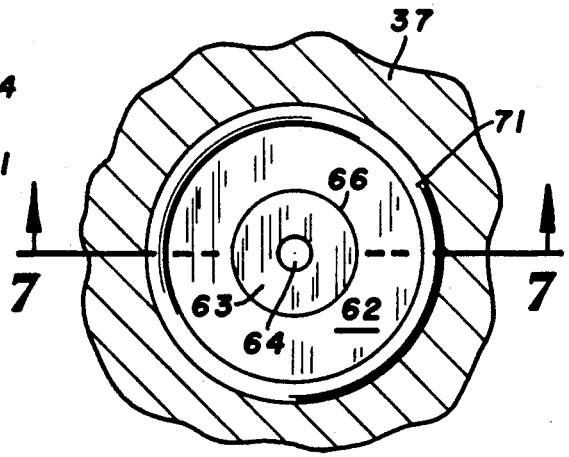
FIG. 6 is an enlarged sectional view taken along the line 6—6 of FIG. 2.
Figure 7:
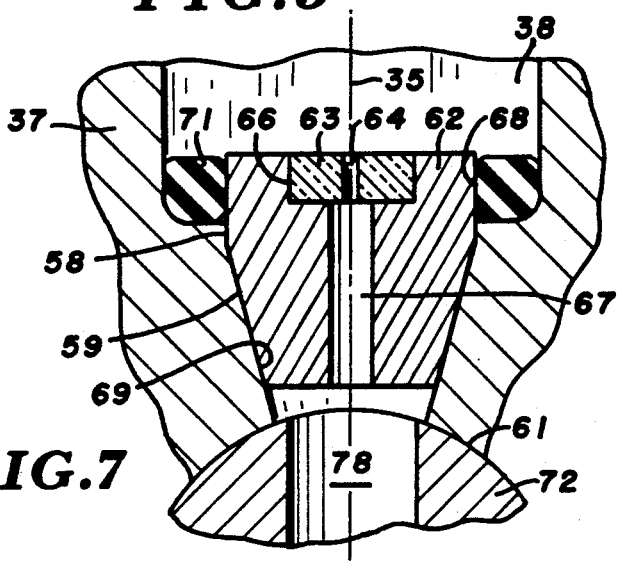
FIG. 7 is a sectional view taken along the line 7—7 of FIG. 6.
Figure 8:
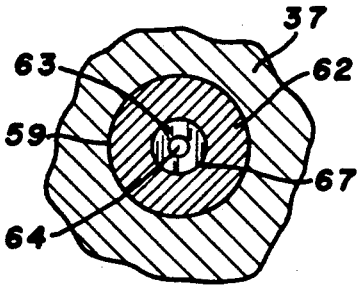
FIG. 8 is an enlarged sectional view taken along the line 8—8 of FIG. 2.

As shown in FIGS. 6 and 7, body 37 has a cylindrical wall 58 at the base of chamber 38. Wall 58 merges into a downwardly converging cone shaped wall 59 open to a transverse cylindrical bore 61. Cylindrical wall 58 and cone shaped wall 59 are concentric with longitudinal axis 35 of body 37. Body 37 is precision machined to accurately form the concentric relationship of the cone shaped wall 59 with longitudinal axis 35 of body 37. A holder 62 supports a cylindrical orifice element 63, such as a ruby or other hard material. Orifice element 63 has a small hole or aperture 64 located in longitudinal alignment with the axis 35 of body 37 and passage 44. Orifice element 63 is located in a cylindrical pocket 66 in the top of holder 62. The outer cylindrical surface of orifice element 63 is in tight fit engagement with the cylindrical wall of pocket 66 to retain orifice element 63 on holder 62. Holder 62 has a passage 67 located below orifice element 63 in axial alignment with hole 64 as shown in FIG. 8. Holder 62 has a cylindrical wall 68 that extends down into cylindrical wall 58 of body 37 and a downwardly tapering cone side wall 69 that fits into cone shaped wall 59 of body 37. The holder cone shaped surface 69 is ground to precision concentric relation relative to the axis 35. Orifice element 63 is premounted on holder 62 and tested for longitudinal alignment of orifice 64 with the axis of the holder. An O-ring or annular member 71 of compressible material surrounds the wall 58 to retain holder 62 on body 37. As seen in FIG. 7, O-ring 71 is compressed into the annular groove around the upper end of holder 62.

Figure 9:
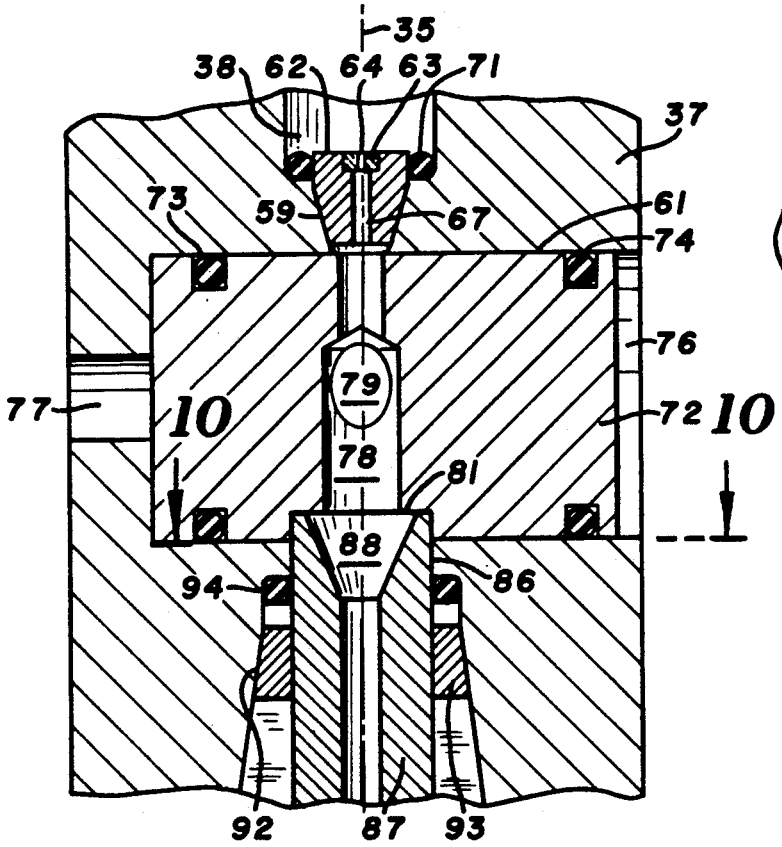
FIG. 9 is an enlarged sectional view taken along the line 9—9 of FIG. 2.
Figure 10:
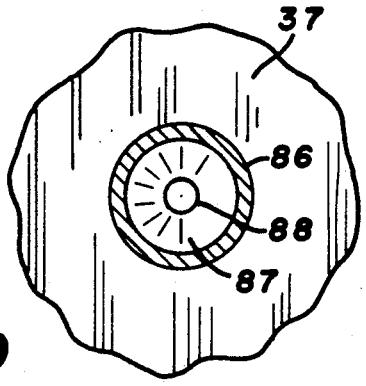
FIG. 10 is a sectional view taken along the line 10—10 of FIG. 9.

As shown in FIGS. 2, 7, and 9, a cylindrical insert or cylinder 72 is located within transverse cylindrical bore 61. Insert 72 is made of abrasion resistent material, such as carbide, to protect the body from wear. A pair of O-rings or annular seals 73 and 74 on opposite ends of insert 72 are located in sealing relation with bore 61. Insert 72 has a transverse groove 76 in one end thereof to accommodate a tool, such as a blade or screw driver, used to rotate and position insert 72 in bore 61. The opposite end of bore 61 has a hole 77 to accommodate a tool for applying force to insert 72 to remove the insert from body 37 and allow replacement of the insert with a new insert.

The mid portion of insert 72 has a transverse chamber 78 open to holder passage 67 and a hole 86 in the bottom of body 37. Insert 72, as shown in FIG. 2, has a lateral passage 79 open to the passage accommodating nipple 26 for delivering abrasive materials such as grit, to chamber 78 where the abrasive materials mix with the high velocity stream of water flowing through chamber 78 shown as arrow 102 in FIG. 2. The bottom of insert 72 has a flat section 81 surrounding the bottom end of chamber 78.

Insert 72 is retained in body 37 with a thumbscrew 82. As shown in FIG. 2, thumbscrew 82 is threaded into a threaded hole 83 in the side body 37. The forward end of thumbscrew 82 fits into a recess or pocket 84 in the side of insert 72 to position and hold chamber 78 in longitudinal alignment with axis 35 and hole 64 in orifice element 63. The stream of high velocity water flowing down the center of chamber 78 picks up abrasive materials in chamber 78 and entrains abrasive materials within the water. The high velocity stream of water flowing through chamber 78 causes a low pressure region around the high velocity stream of water that draws the abrasive material into the water whereby the abrasive material is carried by the water into passage 88 of nozzle 87.

Figure 11:
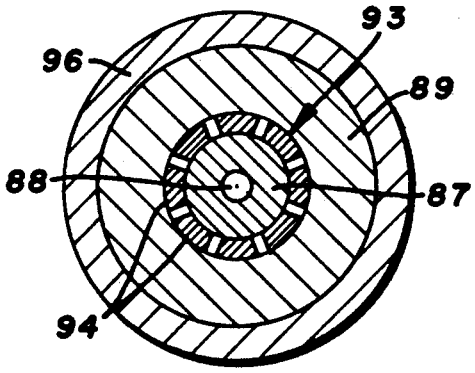
FIG. 11 is an enlarged sectional view taken along the line 11—11 of FIG. 2.
Figure 12:
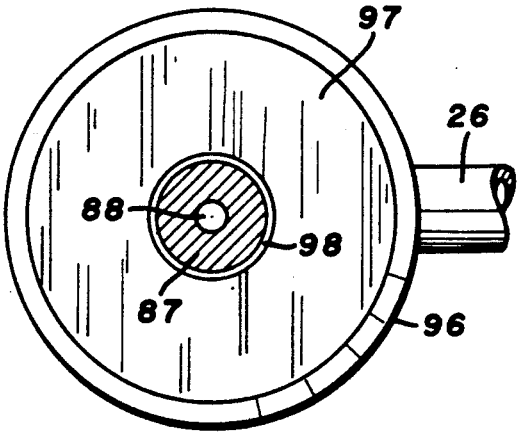
FIG. 12 is an enlarged sectional view taken along the line 12—12 of FIG. 2.

An elongated cylindrical nozzle 87 having a longitudinal passage 88 is mounted on body 37 in longitudinal alignment with the axis 35 of chamber 78 and hole 64 in orifice element 63. In one form of the nozzle, passage 88 has an elongated slightly tapered inside wall terminating in a cylindrical end having a discharge opening 89. An example of a wear resistant carbide nozzle is shown by Goodwin et al in U.S. Pat. No. 3,419,220. Other types of nozzles can be used with cutting head 13. Nozzle 87 is a cylindrical tube of abrasive resistant material, such as carbide. Other types of hard and wear resistant materials can be used for nozzle 87. The upper end of nozzle 87 is located in engagement with the bottom of insert 72. A relatively short longitudinal distance separates orifice element 63 from the entrance of passage 88 of nozzle 87. This short distance minimizes angular misalignment of orifice element 63 relative to nozzle 87 and maintains water stream coherency through chamber 78. Nozzle 87 extends through a downwardly directed boss 90 on body 37. Boss 90 has external threads 91 adapted to accommodate a cup shaped member or cap 96. Boss 90 has an upwardly converging tapered inside wall 92 that extends upwardly to hole 86. An O-ring 95 surrounds nozzle 87 at the base of inside wall 92 to seal hole 86 to prevent air from flowing into passage 88 and maintain a vacuum in chamber 78. Nozzle 87 is retained in aligned assembled relation with the axis 35 of body 37 with an annular split collet 93. The outside surface of collet 93 has tapered fingers 94 that fit in surface engagement with the tapered inside wall 92 of boss 90. Inside wall 92 has an upwardly converging cone surface concentric with axis 35. Wall 92 is precision machined to ensure accurate concentric relation of wall 92 with axis 35. Collet 93 shown in FIG. 11, has a plurality of circumferentially spaced fingers 94 that are alternately joined together at their opposite ends to form annular collet 93. Fingers 94 have arcuate inside surfaces located in tight surface engagement with the outside surface of nozzle 87. As shown in FIGS. 2 and 12, cap 96 has a bottom 97 that engages the bottom of collet 93 and a hole 98 for nozzle 87. When cap 96 is turned onto boss 90, fingers 94 of collet 93 will circumferentially contract to firmly grip nozzle 87. The cone shaped tapered wall 92 maintains the axial alignment of nozzle 87 with axis 35 and hole 64 of orifice element 63. Collet 93 can be removed from body 37 to allow nozzle 87 to be replaced with a new nozzle. The longitudinal alignment of the passage of the new nozzle with axis 35 is maintained as the cone wall 92 has zero clearance.

In use, as shown in FIG. 2, water under ultra high pressure, such as 25,000 or more psi, is delivered via pipe 23, indicated by arrow 99, to coupling 43 which carries the water via passage 44 to chamber 38 of body 37. A continuous stream of high velocity water, indicated by arrow 102, eminates from orifice opening 64 and is directed into chamber 78 of insert 72. Stream coherency is maintained because water inlet passage 38 has a relatively large cross sectional area relative to the small cross sectional area of hole 64, as shown in FIGS. 6 and 7. The abrasive material flows through the passage of nipple 26, as indicated by arrow 101, and intermixes with the water steam flowing through chamber 78. The mixture of water and abrasive material in the water jet is carried downwardly into passage 88 of nozzle 87. The abrasive material entrained in the water stream accelerates with the water and is discharged though opening 89 as an abrasive carrying water jet 12. As shown in FIG. 1, jet 12 functions to cut the workpiece 11. A collector 103 located below workpiece 11 catches jet 12 and materials cut from workpiece 11. An example of a collector for a water jet cutting machine is disclosed in U.S. Pat. No. 4,937,985, incorporated herein by reference. The materials accumulated in collector 103 may be delivered to a liquid solid separator (not shown) via hose 104.

The parts of cutting head 13 can be removed and replaced with new parts without realigning or adjusting relative to the longitudinal flow axis 35 through cutting head 13. Nozzle 87 can be removed by releasing cap 96 from boss 90. Collet 93 is then released. Nozzle 87 is free to be withdrawn downwardly from body 37. A new nozzle can then be inserted into collet 93 which grips the nozzle and is held in position with the cap 96. Collet 93 working against the tapered inside wall 92 realigns and maintains the longitudinal axial alignment of passage 88 of nozzle 87 with axis 35 and hole 64 of orifice element 63.

Insert 72 can be removed from body 37 by releasing thumbscrew 82 and lowering nozzle 87. A tool, such as a punch can be inserted through hole 77 to force insert 72 out of cylindrical bore 61. A new insert is moved into bore 61 toward hole 77. A tool cooperating with groove 76 turns insert until chamber 78 is in alignment with orifice 64 and passage 88. As shown in FIG. 2, thumb screw 82 projected into recess 84 retains insert 72 in its aligned position.

Holder 62 and orifice element 63 carried by can be removed as a unit from body 37. The body is released from end 42. Insert 72 is removed from transverse bore 61. Holder 62 is then moved upwardly into chamber 38 and removed there from. A new insert is then placed in engagement with the cone shaped wall 59 and retained therein with the annular member 71. The cone shaped wall 59 axially aligns orifice 64 of orifice member 63 with the longitudinal axis 35 of the water flow axis of the chamber 78 and nozzle passage 88.

While there has been shown and described a preferred embodiment of the water jet cutting apparatus and cutting head therefor, it is understood that changes, modifications, different materials, and arrangement of structures, can be made by those skilled in the art without departing from the invention. The invention is defined in the following claims.

I claim:

1. A cutting head for a water jet cutting machine comprising:

a body having a longitudinal axis and a water inlet chamber for receiving water under pressure, an orifice element having an orifice aligned with said axis open to the chamber for discharging a high velocity stream of water, a holder supporting the orifice element, said holder having an outlet passage axially aligned with said axis, said body having a converging cone shaped recess open to the chamber with an axis aligned with the longitudinal axis of the body, said holder having a cone shaped surface adapted to fit into the cone shaped recess to align the orifice with said longitudinal axis, an annular member surrounding said holder and engageable with an inside wall of the body forming the water inlet chamber retaining the holder on the body, means having a chamber with an axis aligned with said longitudinal axis, an elongated nozzle having a passage open to the orifice and aligned with said longitudinal axis for receiving the high velocity stream of water and discharging the same as a water jet, collet means for holding the nozzle on said body with the passage aligned with said longitudinal axis, said body having a cone shaped diverging wall with an axis aligned with the longitudinal axis of the body, said collet means having surface means adapted to engage the cone shaped diverging surface of the body to align the passage with the longitudinal axis, and means holding the collet means on said body.

2. The cutting head of claim 1 wherein: the annular member surrounding said holder is a ring of compressible material.

3. The cutting head of claim 1 wherein: the means holding the collet means on the body comprises a cap having a hole accommodating the nozzle, a wall engagable with the collet means, and means releasably connecting the cap to the body whereby the cap can be removed from the body to release the collet means and remove the nozzle from the body.

4. The cutting head of claim 3 wherein: the collet means has a plurality of fingers having inside surfaces engagable with the nozzle and tapered outside surfaces engagable with the cone shaped diverging wall of the body.

5. A cutting head for a water jet cutting machine comprising:

a body having a longitudinal axis and a water inlet chamber for receiving water under pressure, an orifice element having an orifice aligned with said axis open to the chamber for discharging a high velocity stream of water, a holder supporting the orifice element, said holder having an outlet passage axially aligned with said axis, said body having a converging cone shaped recess open to the chamber with an axis aligned with the longitudinal axis of the body, said holder having a cone shaped surface adapted to fit into the cone shaped recess to align the orifice with said longitudinal axis, means retaining the holder on the body, means having a chamber with an axis aligned with said longitudinal axis, an elongated nozzle having a passage aligned with said longitudinal axis for receiving the high velocity stream of water and discharging the same as a water jet, collet means for holding the nozzle on said body with the passage aligned with said longitudinal axis, said body having a cone shaped diverging wall with an axis aligned with the longitudinal axis of the body, said collet means having surface means adapted to engage the cone shaped diverging surface of the body to align the passage with the longitudinal axis, means holding the collet means on said body, said body having a transverse bore extended across said longitudinal axis downstream of the orifice element, said means having a chamber comprising an insert located in said bore, said insert having the chamber with an axis aligned with said longitudinal axis, and means holding the insert on the body.

6. The cutting head of claim 5 wherein: the body has a first passage for accommodating abrasive material open to the bore, said insert having a second passage open to the chamber in the insert and the first passage whereby abrasive material is introduced into the insert chamber for entrainment with a stream of water flowing through said insert chamber.

7. The cutting head of claim 5 wherein: the means holding the insert on the body includes releasable means mounted on the body engagable with the insert to fix the position of the insert on the body, said releasable means being movable out of engagement with the insert whereby the insert can be removed from said body.

8. A cutting head for a water jet cutting machine comprising:

a body having a longitudinal axis and a water inlet chamber for receiving water under pressure, an orifice element having an orifice aligned with said axis open to the chamber for discharging a high velocity stream of water, a holder supporting the orifice element, said holder having an outlet passage axially aligned with said axis, said body having a converging cone shaped recess open to the chamber with an axis aligned with the longitudinal axis of the body, said holder having a cone shaped surface adapted to fit into the cone shaped recess to align the orifice with said longitudinal axis, means retaining the holder on the body, means having a chamber with an axis aligned with said longitudinal axis, an elongated nozzle having a passage aligned with said longitudinal axis for receiving the high velocity stream of water and discharging the same as a water jet, collet means for holding the nozzle on said body with the passage aligned with said longitudinal axis, said body having a cone shaped diverging wall with an axis aligned with the longitudinal axis of the body, said collet means having surface means adapted to engage the cone shaped diverging surface of the body to align the passage with the longitudinal axis, means holding the collet means on said body, a member having a cylindrical pilot surface and a water inlet passage concentric with said longitudinal axis, said body having a cylindrical surface engagable with the pilot surface to align the body on the member, and means connecting the body to the member.

9. A cutting head for a water jet cutting machine comprising:

a body having a longitudinal axis and a water inlet chamber for receiving water under pressure, said body having a transverse bore extended across said axis, first means including an orifice aligned with said axis open to the chamber and said bore, an insert located in said bore having a chamber with an insert axis aligned with said longitudinal axis of the body, and an elongated nozzle having a passage aligned with said longitudinal axis mounted on the body whereby water under pressure flows through said orifice, insert chamber, and passage of the nozzle along said longitudinal axis.

10. The cutting head of claim 9 including: means holding the insert on the body having releasable means mounted on the body engagable with the insert to fix the position of the insert on the body, said releasable means being movable out of engagement with the insert whereby the insert can be removed from said body.

11. The cutting head of claim 9 including: collet means for holding the nozzle on said body with the passage aligned with said axis, said body having a cone shaped diverging inside wall with an axis aligned with the longitudinal axis of the body, said collet means having surface means adapted to engage the cone shaped diverging wall of the body to align the passage with the longitudinal axis.

12. The cutting head of claim 11 including: means holding the collet means on the body comprising a cap having a hole accommodating the nozzle, a wall engagable with the collet, and means releasably connecting the cap to the body whereby the cap can be removed from the body to release the collet means and remove the nozzle from the body.

13. The cutting head of claim 11 wherein: the collet means has a plurality of fingers having inside surfaces engagable with the nozzle and tapered outside surfaces engagable with the cone shaped diverging wall of the body.

14. The cutting head of claim 9 wherein: the body has a first passage for accommodating abrasive material open to the bore, said insert having a second passage open to the chamber in the insert and the first passage whereby abrasive material can be introduced into the insert chamber for entrainment with the stream of water flowing through said insert chamber.

15. The cutting head of claim 9 including: a member having a cylindrical pilot surface and a water inlet passage concentric with said longitudinal axis, said body having a cylindrical surface engagable with the pilot surface to align the body on the member, and means connecting the body to the member.

16. A cutting head for a water jet cutting machine comprising: a body having a longitudinal axis and a water inlet chamber for receiving water under pressure, an orifice element having an orifice aligned with said axis open to the chamber, a holder supporting the orifice element, said holder having an outlet passage axially aligned with said axis, said body having a converging cone shape recess open to the chamber with an axis aligned with the longitudinal axis of the body, said holder having a cone shape surface adapted to fit into the cone shape recess to align the orifice with said axis, annular means surrounding the holder and engagable with said body to seal and retain the holder on the body, said body having an internal chamber, an elongated nozzle having a passage aligned with said axis open to the internal chamber, collet means for holding the nozzle on said body with the passage of the nozzle aligned with said axis, said body having a cone shaped diverging wall with an axis aligned with the longitudinal axis of the body, said collet means having cone surface means adapted to engage the cone shaped diverging wall of the body to align the passage of the nozzle with the longitudinal axis, and means holding the collet means on said body.

17. The cutting head of claim 16 wherein: the annular means comprises an annular member of compressible material surrounding said holder and engageable with an inside wall of the body forming the water inlet chamber.

18. The cutting head of claim 16 wherein: the means holding the collet means on the body comprises a cap having a hole accommodating the nozzle, a wall engageable with the collet means, and means releasably connecting the cap to the body whereby the cap can be removed from the body to release the collet means and remove the nozzle from the body.

19. The cutting head of claim 18 wherein: the collet means has a plurality of fingers having inside surfaces engageable with a nozzle and tapered outside surfaces engageable with the cone shaped diverging wall of the body.

20. The cutting head of claim 16 wherein: the body has a first passage for accommodating abrasive material open to the internal chamber whereby abrasive material is introduced into the internal chamber for entrainment with the stream of water flowing through said internal chamber into the passage of the nozzle.

21. A cutting head for a water jet cutting machine comprising: a body having a longitudinal axis and a water inlet chamber for receiving water under pressure, an orifice element having an orifice aligned with said axis open to the chamber, a holder supporting the orifice element, said holder having an outlet passage axially aligned with said axis, said body having a converging cone shape recess open to the chamber with an axis aligned with the longitudinal axis of the body, said holder having a cone shape surface adapted to fit into the cone shape recess to align the orifice with said axis, means retaining the holder on the body, said body having an internal chamber, an elongated nozzle having a passage aligned with said axis, collet means for holding the nozzle on said body with the passage of the nozzle aligned with said axis, said body having a cone shaped diverging wall with an axis aligned with the longitudinal axis of the body, said collet having a surface means adapted to engage the cone shaped diverging wall of the body to align the passage of the nozzle with the longitudinal axis, means holding the collet means on said body, a member having a cylindrical pilot surface and a water inlet passage concentric with said longitudinal axis, said body having a cylindrical surface engagable with the pilot surface to align the body on the member, and means connecting the body to the member.

22. The cutting head of claim 21 wherein: the means retaining the holder on the body is an annular member surrounding the holder and compressed into sealing engagement with the holder and inside wall of the body forming the water inlet chamber.

23. The cutting head of claim 21 wherein: said body having a converging cone shape surface forming said recess, said surface having a longitudinal axis aligned with the longitudinal axis of the body, and said cone shape surface of the holder being located in surface engagement with cone shape surface of the body to align the orifice of the orifice element with the longitudinal axis of the body.

24. A cutting head for a water jet cutting machine having a body with a longitudinal axis extended through a water chamber in the body for receiving water under pressure, an orifice element having an orifice aligned with the axis open to the chamber, a holder supporting the orifice element, an elongated nozzle having a passage open to the orifice and aligned with the axis, a collet for holding the nozzle on the body, and a cap holding the collet on the body characterized by the body having a recess with a converging cone shape surface, the holder having a cone-shape surface that fits into the recess to align the orifice with the axis, an annular member surrounding the holder to seal and retain the holder relative to an inside wall of the body forming the water chamber, the body having a cone shape diverging wall with an axis aligned with the longitudinal axis of the body, and the collet having a tapered surface means engageable with the cone shape diverging wall to align the passage of the nozzle with the longitudinal axis so that the orifice and passage in the nozzle are located in longitudinal alignment.

25. The cutting head of claim 24 wherein: the cone-shaped surface of the recess and cone-shaped surface of the holder are located in surface engagement.

26. The cutting head of claim 24 wherein: the annular member is a ring of compressible material surrounding the holder and compressed into sealing engagement with the holder and inside wall of the body forming the water inlet chamber.

27. The cutting head of claim 24 wherein: the collet has a plurality of fingers having inside surfaces engageable with the nozzle and tapered outside surfaces engageable with the cone shaped diverging wall of the body.

28. The cutting head of claim 24 wherein: the body has an internal chamber between the holder and nozzle aligned with said axis, and a passage for accommodating abrasive material open to the internal chamber whereby abrasive material is introduced into the internal chamber for entrainment with the stream of water flowing through said internal chamber into the passage of the nozzle.

29. The cutting head of claim 24 wherein: said body has a transverse bore extended across said axis, and an insert located in said bore having a chamber with an insert axis aligned with said longitudinal axis of the body whereby water under pressure flows through said orifice, insert chamber, and passage of the nozzle along said longitudinal axis.

* * * * *